United States Patent [19]

Itou

[11] Patent Number: 4,750,412

[45] Date of Patent: Jun. 14, 1988

[54] PAINTING APPARATUS

[75] Inventor: Zyouzi Itou, Toyota, Japan

[73] Assignee: Toyota Jidosha Kabushiki Kaisha, Aichi, Japan

[21] Appl. No.: 41,415

[22] Filed: Apr. 23, 1987

[30] Foreign Application Priority Data

Apr. 24, 1986 [JP] Japan ..... 61-93331
Apr. 25, 1986 [JP] Japan ..... 61-94715
Apr. 25, 1986 [JP] Japan ..... 61-61841[U]

[51] Int. Cl.[4] ..... B05B 15/12

[52] U.S. Cl. ..... 98/115.2; 55/DIG. 46; 118/326

[58] Field of Search ..... 55/DIG. 46; 98/115.2; 118/326, DIG. 7

[56] References Cited

U.S. PATENT DOCUMENTS 2,244,040 6/1941 Alexander ..... 118/326 X
3,395,972 8/1968 Hardison ..... 98/115.2 X
3,807,291 4/1974 Roberts et al. ..... 98/115.2
4,173,079 11/1979 Cruff et al. ..... 34/217
4,313,369 2/1982 Tsuruta et al. ..... 98/115.2
4,664,061 5/1987 Morioka et al. ..... 98/115.2

*Primary Examiner*—Harold Joyce
*Attorney, Agent, or Firm*—Finnegan, Henderson, Farabow, Garrett and Dunner

[57] ABSTRACT

A painting apparatus having a booth with a painting room for defining a path having a U-shaped configuration wherein a front painting zone and a rear painting zone are adjacent each other in the legs of the path. An intermediate zone is located at the bight of the U-shaped path. An air supply and exhaust system is provided for the zones. A duct to the front and rear zones does not interfere with a duct to the intermediate zone. An exhaust system re-circulates the air in the intermediate zone and includes a solvent adsorber and a total heat exchanger upstream in the direction of air flow for adsorbing solvent and recovering sensible and latent heat.

12 Claims, 8 Drawing Sheets

PAINTING APPARATUS

BACKGROUND OF THE INVENTION

1. Field of the Invention

The present invention relates to a painting apparatus; and more particularly to a painting apparatus having a booth, an air supply system and an exhaust system.

2. Description of the Prior Art

In conventional painting apparatus, which has a booth, and wherein objects are painted while passing through the booth, such as car bodies, for example, the booth is formed along a straight path. Thus, objects to be painted are brought into the booth through an entrance at one end of the booth and conveyed in a straight line through several successive zones in the booth, and then the objects are brouqht out of the booth at an exit located at the end of the booth opposite the entrance. An example of such painting apparatus is described in the July 1984 issue of a publication entitled "PRODUCT FINISHING" which has an exhaust air circulation system similar to that illustrated in FIG. 1. As shown in FIG. 1, booth 1 is constructed to extend along a straight path or line in the conveying direction 2 of the objects being painted. The room or space in the booth is divided into several zones, such as manual painting zones, an automatic painting zone, etc. Generally, in a booth for car bodies, manual painting zones are positioned at the front and rear portions of the booth in the longitudinal direction of the booth, and an automatic painting zone is positioned in an intermediate portion of the booth. In FIG. 1, air conditioner 3 for manual painting zones and air conditioner 4 for automatic painting zone are provided in the front and rear positions of the booth 1. From air conditioners 3 and 4, controlled air is supplied to each zone via ducts, part of the air exhausted from the zones, is circulated to a specific zone (usually an automatic painting zone), and the remainder of the exhausted air is directed to the outside of the system.

In the drying technology following the painting of an object, as shown in FIG. 2, a drying oven 6 having a conveyor line 5, which reverses direction of turning back upon itself is known.

In the above-mentioned straight booth which has manual painting zones in the front and rear portions of the booth, for instance, as shown in FIG. 3, air supply duct 9 extends from air conditioner 3 for manual painting zones 7 and 8. The air supply duct to manual painting zone 8 interferes with air supply duct 11 extending from automatic painting zone air conditioner 4 to automatic painting zone 10. To avoid the interference, air supply duct 9 or 11 must be formed in a complicated shape, thereby decreasing the design freedom and increasing the difficulty in the construction of the duct. Although exhaust ducts are not shown in FIG. 3, there are similar problems with exhaust ducts. To solve the above problems, a separate air conditioner may be provided for the front manual painting zone 7, and the rear manual painting zone 8. However, since the air conditioner itself is large and expensive, it is difficult and impractical to provide an air conditioner for each of the two painting zones. In recent years, robots have been used in automatic painting zones. Usually, the use of robots necessitates increasing the entire length of the booth over that of a conventional booth. Therefore, duct 9 in FIG. 3 tends to become longer, thereby increasing the difficulty and cost in the construction of the duct.

Moreover, there is a basic space problem in construction of the conventional painting apparatus with a straight line booth. The width of the straight line booth for car bodies is about 5 meters, but the width of the air conditioner is, for example, 10–15 meters. Thus, the air conditioner cannot be placed directly on the booth. Typically, as shown in FIG. 3, air conditioners 3 and 4 are installed at positions laterally spaced from the upper portion of booth 12, with only the ducts being positioned above the booth 12. In the arrangement of such a structure, a wide space is required for the entire apparatus.

Additionally, there is a problem with heat energy in the conventional painting apparatus. There are two types of air supply and exhaust systems for a booth. One is a system where exhaust air from one zone of the booth is circulated as supply air to another zone via an air conditioner. Another is a system where exhaust air from a zone of the booth is exhausted to the outside of the booth without circulation to another zone. In any type of such system, since the exhausted air contains solvent, it is necessary to purify finally exhausted air by recovering the solvent contained in the exhausted air with a solvent adsorber. In a conventional system, for example as shown in FIG. 4, the intake air through filter 21 and controlled by air conditioner 22, is forced into painting room 24 by air supply fan 23. The air from the painting room 24 is exhausted to the outside by exhaust fan 25, as purified air, after most of the solvent contained in the exhausted air is recovered by solvent adsorber 26.

In such a system, however, since the air in the painting room 24 picks up a paint mist, a means such as a wet scrubber 27 of FIG. 4 is provided, to catch the paint mist contained in the exhausted air. Thus, air exhausted from the booth is in a state of high humidity. Consequently, in addition to the solvent, a large amount of water is adsorbed by solvent adsorber 26. The solvent adsorption ability of the solvent adsorber 26 thus decreases by the amount of the adsorbed water. As a result, the frequency of regeneration for the solvent adsorber 26 becomes high, and large amounts of heat energy must be consumed for the regeneration.

Furthermore, there is a problem with energy efficiency in a conventional painting apparatus having a flash-off zone in a booth. The flash-off zone is usually provided at a position between a front painting zone and rear painting zone. In the apparatus having such a flash-off zone, the air system (that is, air supply and exhaust system) for the flash-off zone is provided separately from the air systems for the front painting zone and the rear painting zone.

However, since the flash-off zone is a zone for evaporating the solvent contained in the paint film of painted objects; and basically, paint mist does not exist in such a zone, the exhausted air from the flash-off zone can be re-circulated back into the flash-off zone.

Actually, however, such re-circulation has not been achieved for the following reason. Since the flash-off zone is positioned between the front and rear painting zones, and there is more or less of an imbalance between the amount of supply air and the amount of exhaust air in the front painting zone and the rear painting zone, an air flow occurs into or through the flash-off zone. Since paint mist exists in the front and rear painting zones, part of the paint mist flows into the flash-off zone together with the above air flow. Therefore, in order to circulate the air in the flash-off zone, the paint mist contained in the circulating air must be almost completely eliminated by a filter. To eliminate the paint mist having very small particle sizes, a high-efficiency filter is required. However, if such a high-efficiency filter is applied, a clogging of the filter occurs in a short period of time. Thus, the life span of a high-efficiency filter is too short, to be practical for use in the air circulation system of the flash-off zone. As a result, even in the air system for the flash-off zone, the air from the flash-off zone cannot be improved by exhausting it to the outside without re-circulation to the flash-off zone. Therefore, it is difficult to improve the heat efficiency in the conventional air system.

SUMMARY OF THE INVENTION

An object of the present invention is to provide a painting apparatus, which can simplify the duct structure on a booth, and can shorten length of the ducts, thereby increasing design freedom, making the construction of the ducts easier and decreasing the cost of construction.

Another object of the present invention is to provide a painting apparatus capable of supporting an air conditioner directly on the booth, thereby decreasing the space required for the painting apparatus as a whole.

A further object of the present invention is to provide a painting apparatus which minimizes the amount of water adsorbed by a solvent adsorber, and increases the solvent adsorption capacity of the adsorber, thereby lengthening the life span of the solvent adsorber and decreasing the consumption of heat energy for the regeneration of the solvent adsorber.

A still further object of the present invention is to provide a painting apparatus which can prevent paint mist from flowing into the flash-off zone, thereby improving the heat efficiency of an air system without any complications.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To accomplish the above objects and in accordance with the purpose of the invention as embodied and broadly described herein, a painting apparatus according to the present invention comprises a booth enclosing a painting room defining a path through which objects being painted are conveyed. The path reverses direction intermediate the ends thereof and extends back beside itself to form the path in a U-shaped configuration with first and second adjacent legs joined by a bight portion, said room having a front printing zone in the first leg of the path, a rear painting zone in the second leg of the path, and an intermediate zone in the bight portion of the path, an air supply means including an air conditioner, a duct connecting the air supply means to the front and rear painting zones, and an air exhaust means for exhausting air from the front and rear painting zones.

In the above painting apparatus, since the painting room path is formed in a U-turn configuration with the front painting zone and the rear painting zone adjacent each other, it becomes unnecessary to extend a duct from an air conditioner for the front and rear painting zones to one of the zones in the longitudinal direction as shown in FIG. 3. The duct may merely extend between the adjoining front and rear painting zones. Therefore, the duct is greatly shortened as compared to the conventional straight line booth, and the interference between such duct and a duct for the intermediate zone is easily prevented. Accordingly, the design freedom of the ducts can be increased, an optimum structure of the ducts can be easily obtained, and the cost of construction of the ducts can be decreased.

As a result of the U-shape configuration of the painting room path, the width of the booth is about twice as large as the width of the conventional straight line booth. Thus, it becomes possible to place an air conditioner having a large width directly on the booth, thereby decreasing the space for the apparatus as a whole. Also, the structure of the duct from the air conditioner on the booth to a zone in the booth can be further simplified and further shortened.

Moreover, as the result of the U-shape of the painting room defining the path, the entire length of the booth is shortened to ½ the length of the conventional booth. Therefore, the length of the booth is restrained even if a long automatic painting zone is required because of the use of robots.

Preferably, in the present invention, a total heat exchanger is provided on the exhaust system at a position upstream of a solvent adsorber, which is provided on the exhaust system. The total heat exchanger can recover the sensible heat and latent heat of the air exhausted from the painting room. Since the latent heat together with the sensible heat is recovered by the total heat exchanger, most of the water contained in the exhaust air in the gaseous phase, changes to the liquid phase, and can be efficiently eliminated from the air at the total heat exchanger. Therefore, the exhaust air having passed through the total heat exchanger is in a state of very low humidity, and the water contained in the air does not adversely affect the solvent adsorber to any great extent. As a result, the solvent adsorber efficiently adsorbs practically all solvent and the time span between each regeneration of the solvent adsorber can be lengthened, thereby decreasing the frequency and the heat energy for the regeneration.

Furthermore, a booth sometimes has a flash-off zone as the intermediate zone. In the present invention, the flash-off zone is located on the U-turn or bight portion of the path in the painting room. Preferably, an exhaust air circulating system is provided for the flash-off zone. The exhaust air circulating system recirculates the air exhausted from the flash-off zone back into the flash-off zone. At the same time, the front painting zone directly communicates with the rear painting zone adjacent to front painting zone, beyond and outside of the flash-off zone. In such a booth, even if there is a difference in air pressure between the front and rear painting zones by an imbalance between the amount of supply air and the amount of exhaust air in each zone, only the air flow, which is generated in a directly communicating passage between the adjacent front and rear painting zones occurs. Namely, an air flow does not occur through or into the flash-off zone. Since there is no air flow from the front or the rear painting zone to the flash-off zone, paint mist in the front and rear painting zones can be prevented from flowing into the flash-off zone. Accordingly, it becomes possible to circulate the air within the flash-off zone, thereby improving the heat efficiency for the flash-off zone and saving heat energy.

BRIEF DESCRIPTION OF THE DRAWINGS

The accompanying drawings, which are incorporated in and constitute a part of this specification, illustrate several embodiments of the invention and toqether with the description serve to explain the principles of the invention.

DETAILED DESCRIPTION OF THE PREFERRED EMBODIMENTS

Figure 1:
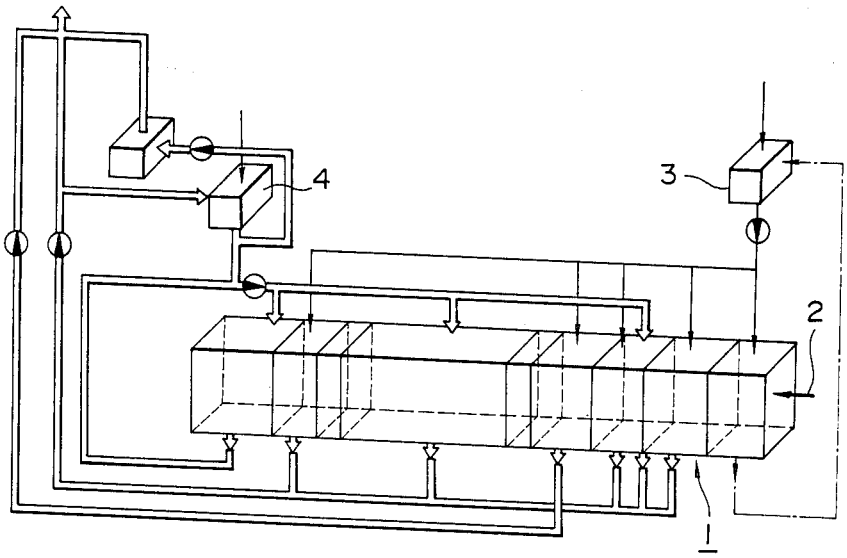
FIG. 1 PRIOR ART
FIG. 1 is a schematic perspective diagram showing an equipment layout and air flows, of a conventional painting apparatus.
Figure 2:
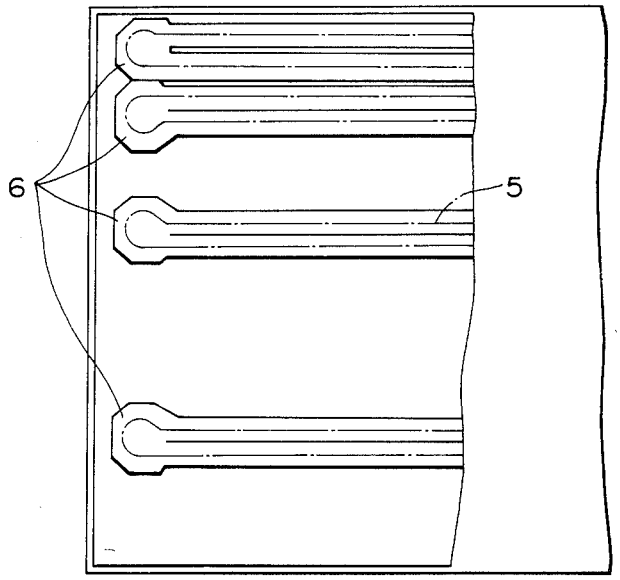
FIG. 2 PRIOR ART
FIG. 2 is a schematic plan view of a conventional drying oven.
Figure 3:
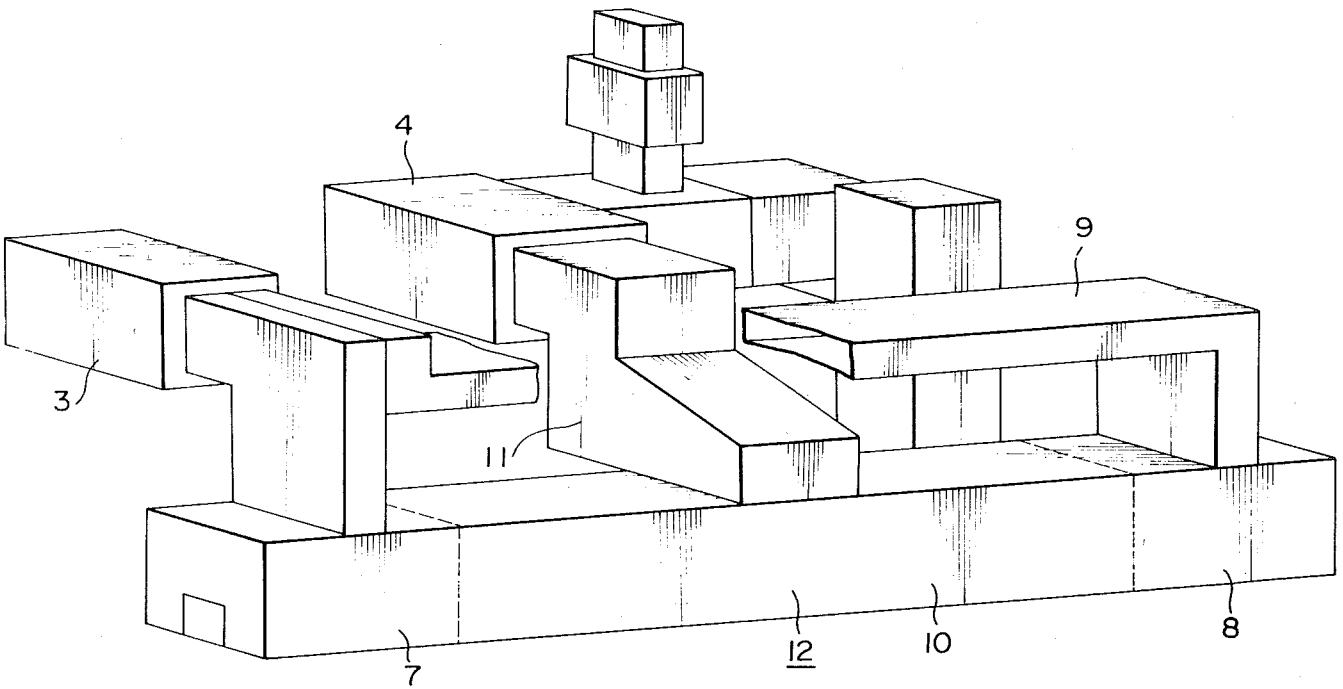
FIG. 3 PRIOR ART
FIG. 3 is a partially cutaway perspective view of a conventional painting apparatus.
Figure 4:
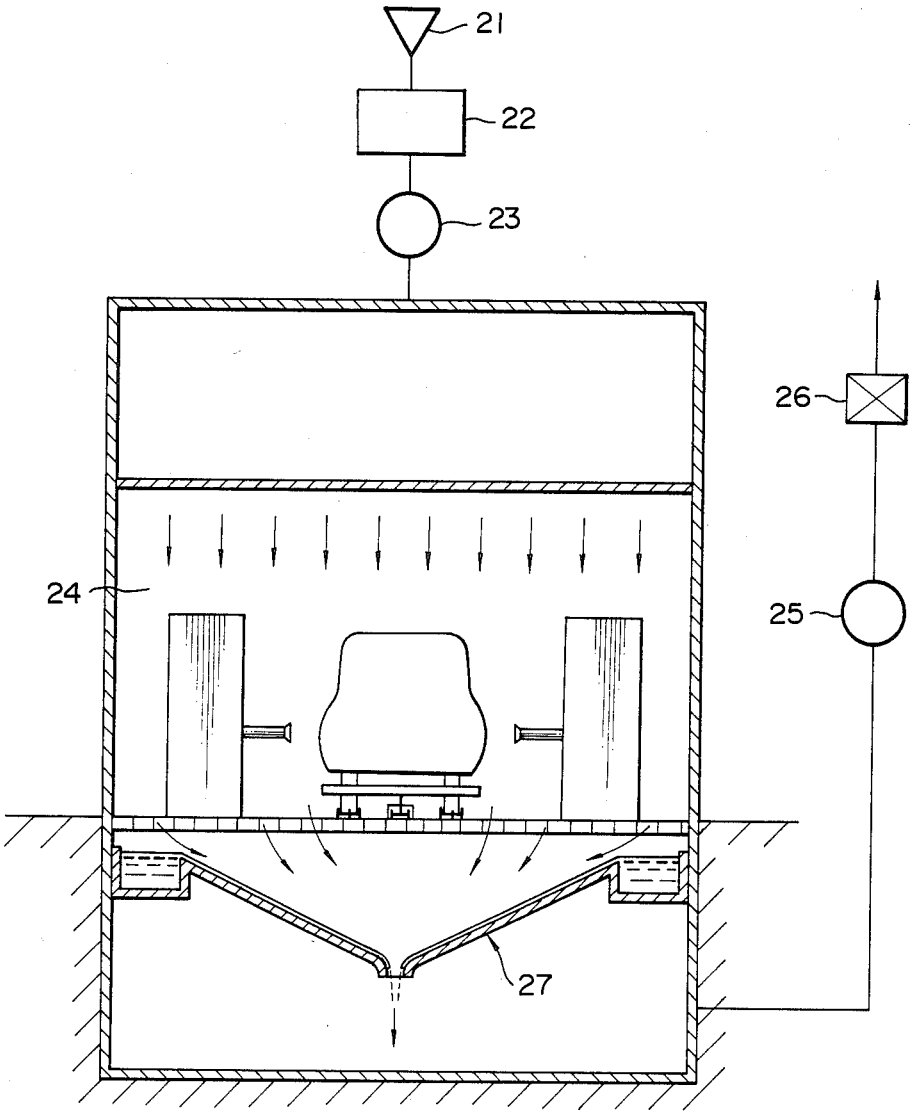
FIG. 4 PRIOR ART
FIG. 4 is a vertical sectional view of a conventional booth.
Figure 5:
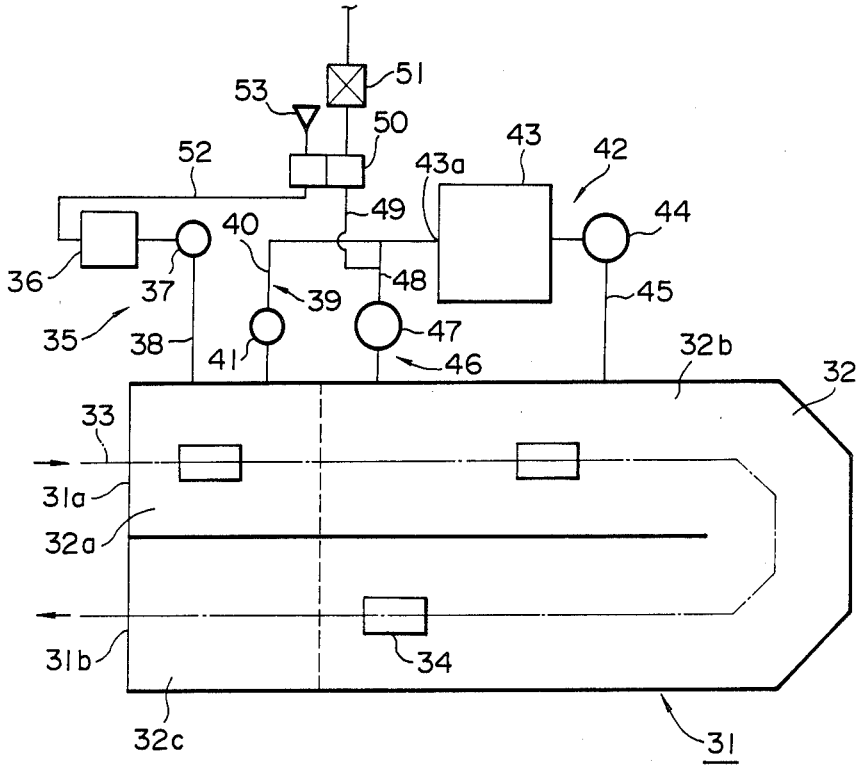
FIG. 5 is a schematic plan view showing a shape of a booth and air system of a painting apparatus according to a first embodiment of the present invention.
Figure 6:
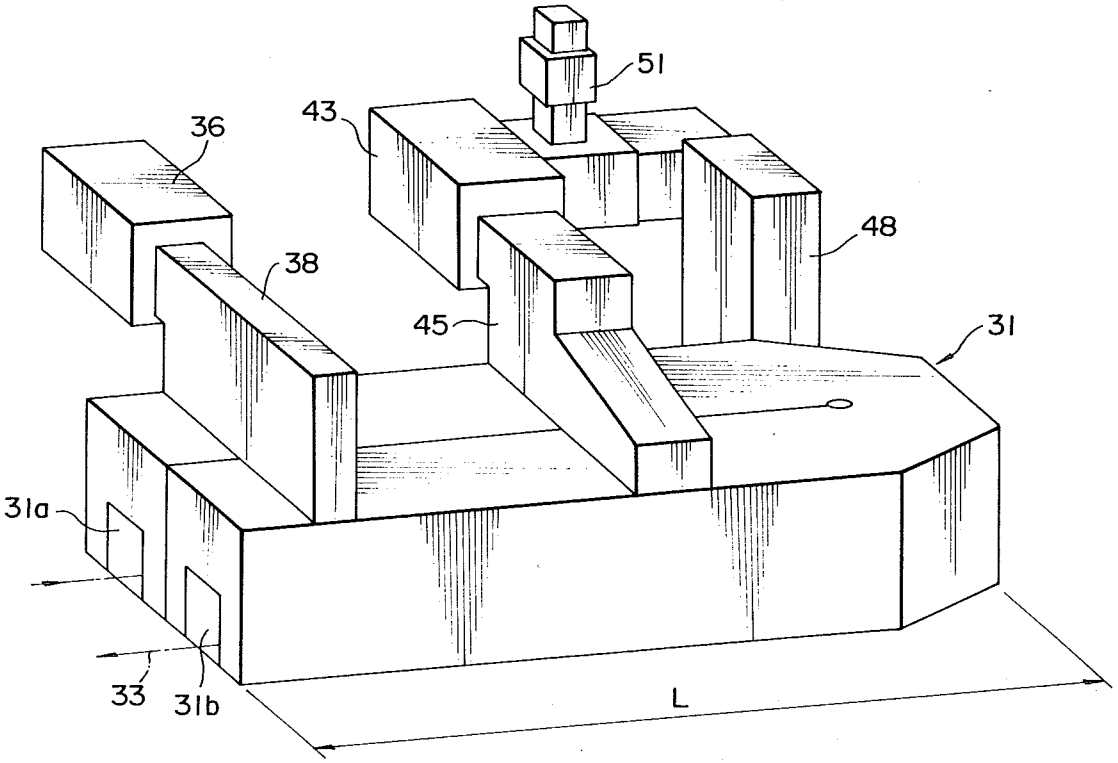
FIG. 6 is a perspective view of the painting apparatus of FIG. 5 according to the present invention.
Figure 7:
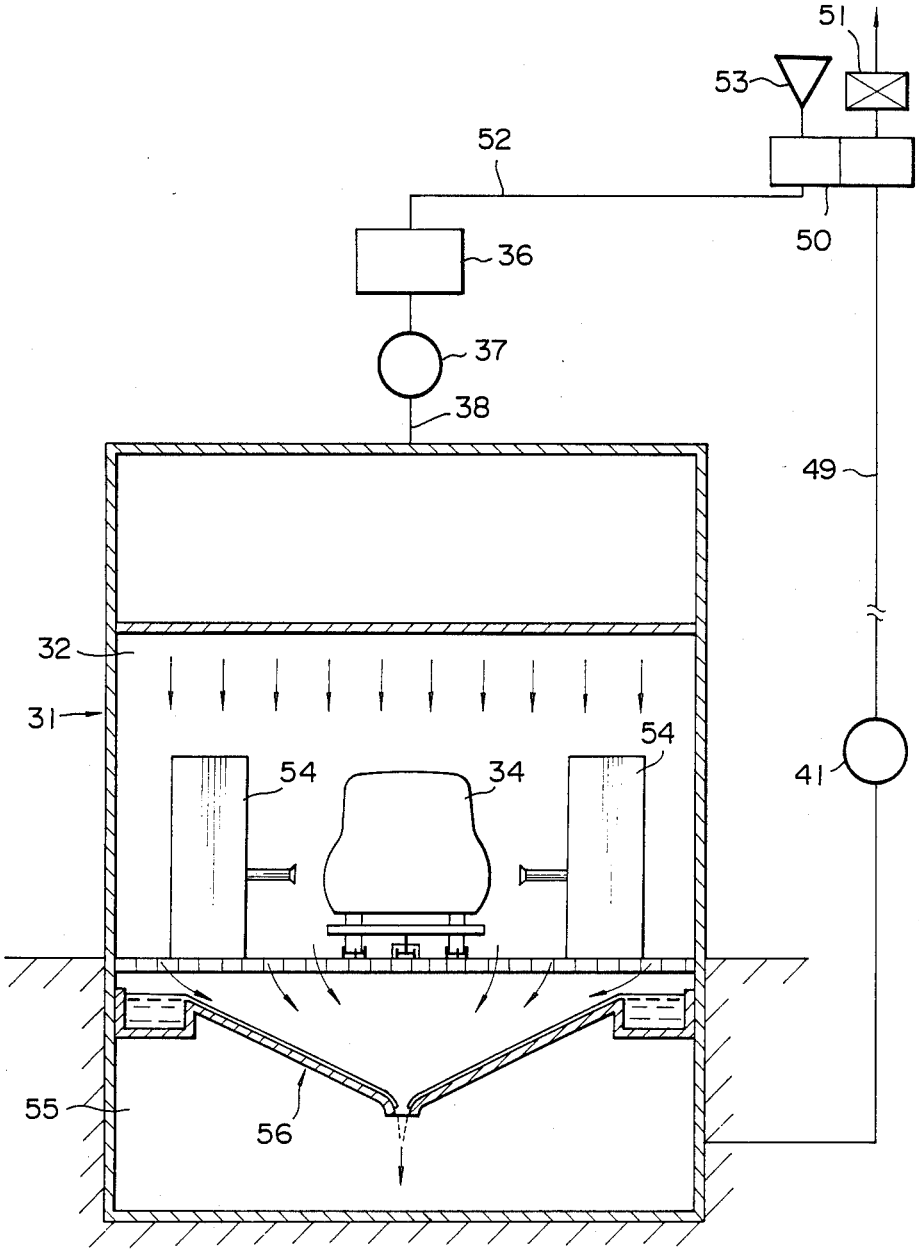
FIG. 7 is a schematic equipment layout diagram showing a vertical section of the booth and the air system of the painting apparatus of FIG. 5 according to the present invention.

The illustrated preferred embodiments of the present invention will be described hereunder referring to the attached drawings wherein like reference numerals refer to similar parts;

FIGS. 5 through 7 show a painting apparatus according to the first embodiment of the present invention. The painting apparatus is an apparatus for painting car bodies, and has an exhaust air circulation type booth. Numeral 31 refers to a booth and numeral 32 refers to a painting room formed in booth 31. Objects 34 to be painted (that is, car bodies) are brought into painting room 32 from the entrance 31*a* of booth 31. Objects 34 are then conveyed along conveyer 33 in the painting room 32; and after painting; objects 34 are then conveyed out of the booth at exit 31*b*.

Painting room 32 is divided into front painting zone 32*a*, intermediate zone 32*b*, and rear painting zone 32*c* in the direction of travel of the objects 34. Front painting zone 32*a* is a front manual painting zone, intermediate zone 32*b* is an automatic painting zone, and rear painting zone 32*c* is a rear manual painting zone in the first described embodiment.

Figure 8:
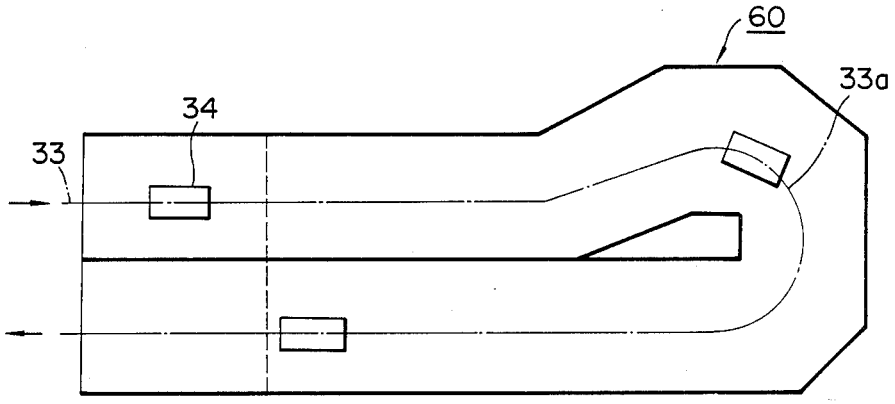
FIG. 8 is a schematic plan view of a booth of a painting apparatus illustrating a second embodiment of the present invention.

Painting room 32 has a path that reverses direction and extends back beside itself to form a U-shaped configuration where front painting zone 32*a* and rear painting zone 32*c* are adjacent to each other. Intermediate zone 32 is located on the bight portion of the path of the U-shaped painting room 32. The U-turn shape in the present invention provides means where an entrance passage and an exit passage for objects 34 in the painting room 32 adjoin each other. Front painting zone 32*a* and rear painting zone 32*c*, thus adjoin each other. Therefore, even the structure of booth 60 as shown in FIG. 8 can be adapted to the present invention. The booth 60 expands in the width direction in the bight or U-turn portion. In such a structure, the radius of curvature of conveyer 33 at the position 33*a* of the bight portion can be increased.

For front painting zone 32*a* and rear painting zone 32*c*, air supply system 35 and exhaust system 39 are provided. Air supply system 35 has filter 53, duct 52, air conditioner 36, fan 37 and duct 38. The atmosphere is drawn in through filter 53, and directed to air conditioner 36 through duct 52. Air conditioner 36 controls the temperature and humidity of the air. The controlled air is forced into painting zone 32*a* and rear painting zone 32*c* by fan 37 through duct 38. Exhaust system 39 has duct 40 leading from front and rear painting zones 32*a* and 32*c*, through fan 41.

For intermediate zone 32*b* (automatic painting zone), air supply system 42 and exhaust system 46 are provided. Air supply system 42 has air conditioner 43, fan 44 and duct 45. Duct 40 which extends from front and rear painting zones 32*a* and 32*c*, is connected to the intake 43*a* of the air conditioner 43, thereby ciruclating the exhausted air from front and rear painting zones 32*a* and 32*c* into intermediate zone 32*b*. Exhaust system 46 has duct 48 and fan 47. The duct 48 diverqes in two directions. One of the branches of the diverqent duct is connected to duct 40. Therefore, a part of the air exhausted from intermediate zone 32*b* is re-circulated into the intermediate zone 32*b*. The other branch of the divergent duct is connected to solvent adsorber 51 through total heat exchanger 50, and the air forced through duct 49 is exhausted to the outside of the system.

FIG. 7 shows schematically an embodiment using an air system with the total heat exchanger 50. Objects 34 are conveyed by conveyer 43 through the painting room 32. Numeral 54 refers to a painting machine. Under the painting room 32, an exhaust chamber 55 is provided, and wet scrubber 56 is provided in the exhaust chamber 55. The air drawn in through filter 53 and controlled by air conditioner 36, is forced into painting room 32 by fan 37. The air flows downward in the painting room 32, and most of paint mist contained in the air flowing from the painting room 32 to the exhaust chamber 55 is caught by wet scrubber 56. The air exhausted from exhaust chamber 55 is forced toward intermediate zone 32*b* by fan 41, and a part of the exhaust air from the intermediate zone 32*b* is exhausted through duct 49 to the outside. The air is exhausted through total heat exchanger 50 and solvent adsorber 51. The total heat exchanger 50 is located at the position upstream of the solvent adsorber 51 on the duct 49 and between the duct 49 and the duct 52. Total heat exchanger 50 can recover the sensible heat and latent heat of the air exhausted from the painting room 32. The recovered heat is utilized to heat the intake air. Solvent adsorber 51 adsorbs the solvent contained in the exhausted air. From the solvent adsorber 51, the purified air is then exhausted. An appropriate adsorbent, for example such as activated carbon, is provided in the solvent adsorber 51.

In the above embodiment, since painting room 32 is of a U-turn shape, and front painting zone 32*a* and rear painting zone 32*c* adjoin each other, the duct 38 for the front and rear painting zones 32*a* and 32*c* becomes a short duct as compared with the conventional duct. Referring to FIG. 6 the short duct 38 does not interfere with the duct 45, for recirculating the air. Therefore, the construction of ducts 38 and 45 is facilitated, and the cost of construction is decreased. Of course, the construction of duct 40 and 48 for the exhausted air is also simplified. Even if the length L of booth 31 (FIG. 6) is increased, it is not necessary to lengthen the ducts 38 and 45.

By configuring the painting room to have a U-shaped path therethrough the length of booth 31 becomes about ½ that of the conventional straight booth, in spite of type of the booth. Accordingly, even if a longer length of a painting room is required to account of the utilization of robots in an automatic painting zone, the booth can still be placed within a restricted space of an existing structure.

Figure 9:
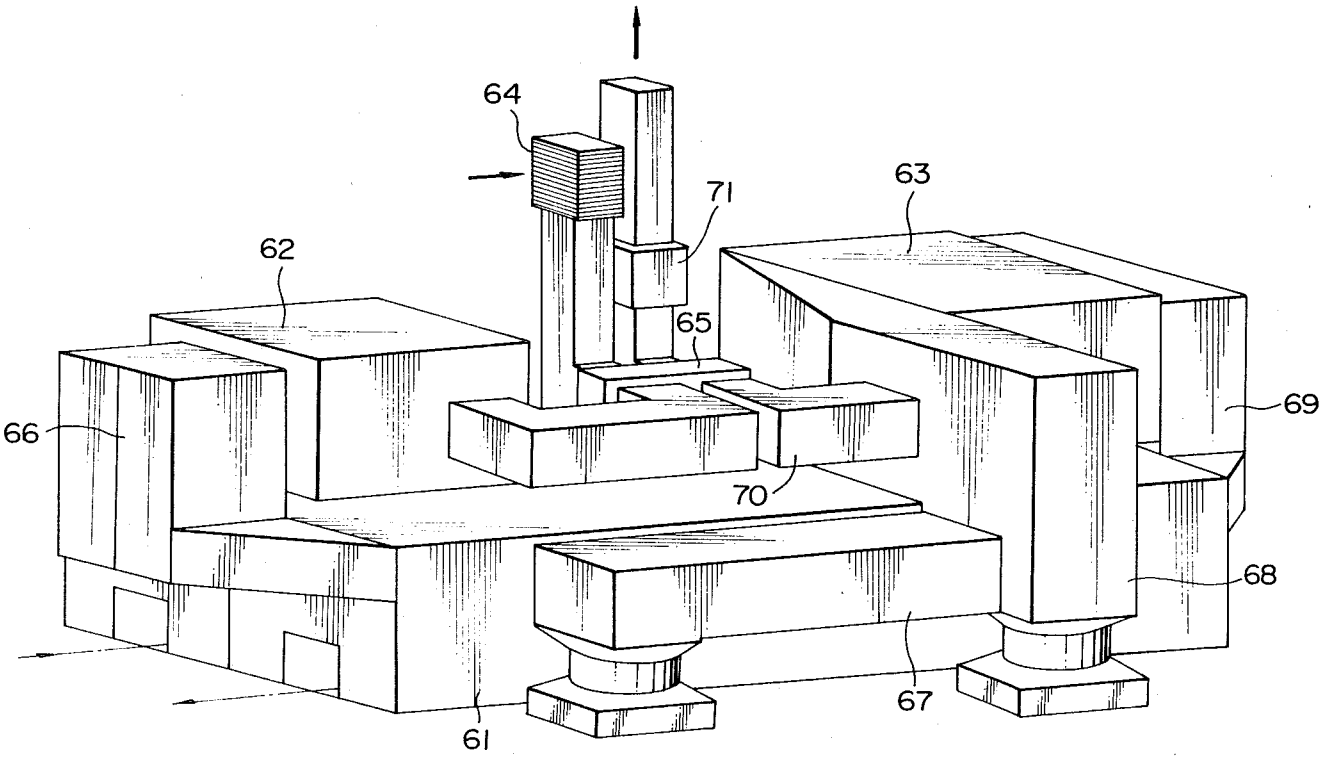
FIG. 9 is a perspective view of the painting apparatus of FIG. 8.

With the U-turn shape, since the entering passage and the returning passage of objects 34 are adjacent, the width of booth 31 becomes two times as large as the conventional straight booth. Therefore, as shown in FIG. 9, the above embodiment can be modified by placing air conditioners 62 and 63 directly on booth 61, thereby decreasing the space needed for the painting apparatus. In FIG. 9, numeral 64 refers to a filter, numeral 65 refers to a total heat exchanger, numerals 66 and 69 refer to air supply ducts, numerals 67 and 68 refer to exhaust ducts, numeral 70 refers to divergent duct, and a numeral 71 refers to a solvent adsorber. In the modification of FIG. 9, the construction of ducts can be further simplified and each duct can be even shorter than the embodiment of FIG. 6.

Moreover, by applying total heat exchanger 50 at position upstream of solvent adsorber 51 in the direction of air flow, the following advantages are obtained.

In the air exhausted from painting room 32, paint mist and solvent are contained. Although most of the paint mist is eliminated by wet scrubber 56, the air after passing through the wet scrubber 56 is in a condition of high humidity, for example 80–90%. This exhaust air is passed through total heat exchanger 50 upstream of solvent adsorber 51. Since the latent heat together with the sensible heat of the exhaust air is recovered in the total heat exchanger 50, the water in the air, having been in a gaseous phase, turns into a liquid phase, to the greatest possible extent. Consequently, the water in the exhaust air is efficiently eliminated by total heat exchanger 50. For instance, the humidity of the air leaving the total heat exchanger 50 is less than 60%. Since dry air is introduced to solvent adsorber 51, practically all the solvent can be efficiently adsorbed by adsorber 51 without adsorption of water. As a result, for example, although the holding ability for solvent of a solvent adsorber in the conventional painting apparatus wihtout a total heat exchanger is about 5% in accordance with weight ratio between adsorbed solvent and activated carbon, the holding ability according to the present invention can be increased to about 30%. In turn, the increase in the holding ability of solvent in the solvent adsorber increases the period between regenerations of the solvent adsorber, thereby decreasing the frequency of the regeneration; and thus also decreases the required heat energy of the regeneration during operation of the painting apparatus.

Figure 10:
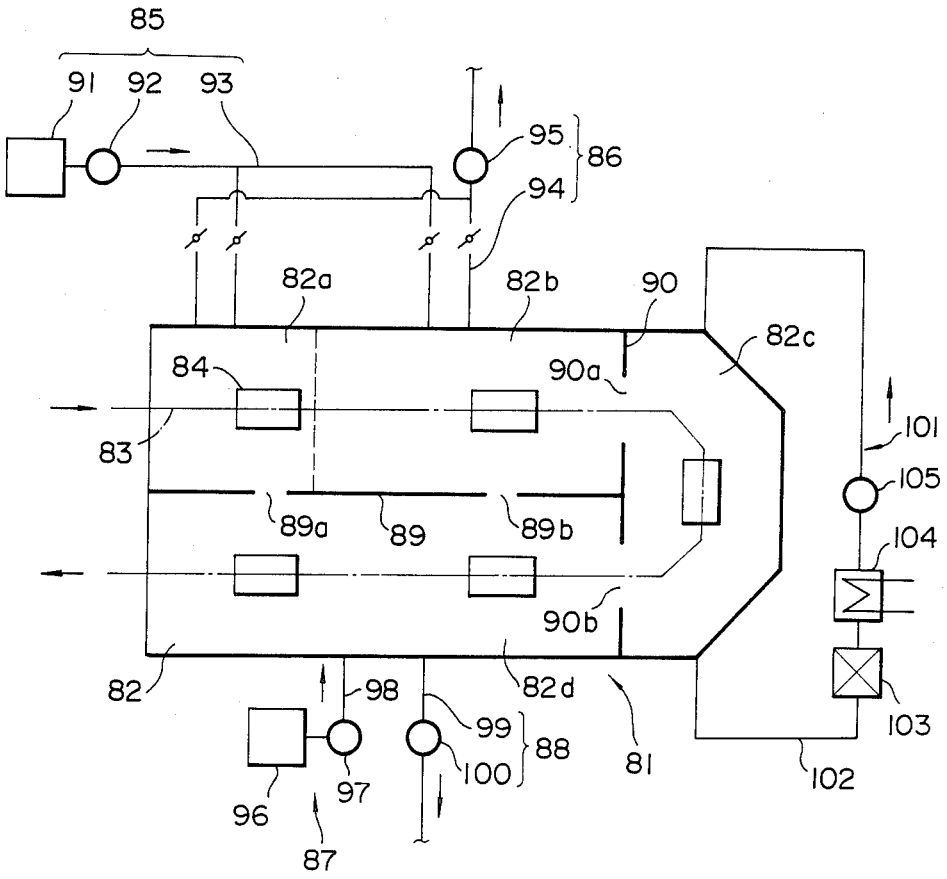
FIG. 10 is a schematic plan view showing a shape of a booth and air systems, of a painting apparatus according to a third embodiment of the present invention.

Next, referring to FIG. 10 which shows another embodiment of the present invention, painting room 82 formed in booth 81 is divided into dusting zone 82*a*, front painting zone 82*b*, intermediate zone 82*c* and rear painting zone 82*d* in the direction of travel of paint objects 84 conveyed by conveyer 83. The intermediate zone 82*c* is constructed as a flash-off zone. The flash-off zone 82*c* is located on the right of the U-shaped portion of painting room 82. Dusting zone 82*a* is a zone for eliminating dust from the paint objects 84. Front painting zone 82*b* is a zone for base coating. Flash-off zone 82*c* is a zone for evaporating solvent from the paint film of the paint objects 84. Rear painting zone 82*d* is a zone for clear coating.

Front painting zone 82*b* adjoins painting zone 82*d* and dusting zone 82*a* also adjoins rear painting zone 82*d* in this embodiment. Although dusting zone 82*a* and front painting zone 82*b*, and rear painting zone 82*d* are partitioned by a partition 89, dusting zone 82*a* directly communicates with rear painting zone 82*d* via opening 89*a* and front painting zone 82*b* directly communicates with the rear painting zone 82*d* via opening 89*b* without any communication between the front and rear painting zones 82*b* through the flash-off zone 82*c*; that is, through openings 90*a* and 90*b* on partition 90 and flash-off zone 82*c*.

In the embodiment of FIG. 10, air supply system 85 and exhaust system 86 for dusting zone 82*a* and front painting zone 82*b*, and air supply system 87 and exhaust system 88 for rear painting zone 82*d* are provided; respectively. Air supply system 85 has air conditioner 91, fan 92 and air supply duct 93. Exhaust system 86 has exhaust duct 94 and fan 95. Air supply system 87 has air conditioner 96, fan 97 and air supply duct 98; and exhaust system 88 has duct 99 and fan 100. Flash-off zone 82*c* has an exhaust air circulating system 101 for circulating the air exhausted from flash-off zone 82*c* back in to the flash-off zone 82*c*. Solvent adsorber 103, heater 104 and fan 105 are provided in the circulatory duct 102 in series, respectively, in the direction of circulation of the exhausted air of the system 101.

In the embodiment in FIG. 10, the air supplied by air supply system 85 and the air exhausted by exhaust system 86 in dusting zone 82*a* and front painting zone 82*b* and the air supplied by air supply system 87 and the air exhausted by exhaust system 88 in rear painting zone 82*d* are all operated separately, and thus, a pressure difference between the zones 82*a* and 82*b*, and 82*d* sometimes occurs, because of an imbalance between the amount of supplied air and the amount of exhausted air in their respective systems. However, even if such a pressure difference occurs, the air in the zones flows only through openings 89*a* and 89*b* from the high-pressure side to the low-pressure side, because the zones are directly in communication through openings 89*a* and 89*b*. Therefore, no air flow occurs between front and rear painting zones 82*b* and 82*d* through flash-off zone 82*c* or into the flash-off zone 82*c* from front painting zone 82*b* or rear painting zone 82*d*. Accordingly, paint mist in the front painting zone 82*b* or rear painting zone 82*d* does not flow into the flash-off zone 82*c*. Since there is no substantial paint mist in flash-off zone 82*c*, the exhaust air from the flash-off zone 82*c* can be re-circulated into flash-off zone 82*c* without creating any difficulties. By the recirculation of the exhausted air, the heat energy in the exhausted air is used effectively. Thus, the heat energy to be consumed in heater 104 can be decreased, achieving large energy saving.

Although several preferred embodiments of the present invention have been described in detail, it will be appreciated by those skilled in the art that various modifications and alterations can be made to the particular embodiments shown without materially departing from the novel teachings and advantages of this invention.

Accordingly, it is to be understood that all such modifications and alternations are included within the scope of the invention, provided they come within the scope of the appended claims and their equivalents.

What is claimed is:

1. A painting apparatus, comprising a booth enclosing a painting room for defining a path through which objects being painted are conveyed, said path reversing direction intermediate the ends thereof and extending back beside itself in a U-shaped configuration with first and second adjacent legs joined by a bight portion, said room having a front painting zone in the first leg of the path, a rear painting zone in the second leg of the path and an intermediate zone in the bight portion of the path;

air supply means including air conditioning means;

duct means connecting said air supply means to said front and rear painting zones for forcing air into said room; and an air exhaust means for exhausting air from said front and rear zones of the room.

2. The apparatus of claim 1, wherein said front painting zone is a front manual painting zone, said intermediate zone is an automatic painting zone for painting objects without manual intervention, said rear painting zone is a rear manual painting zone, and said front manual painting zone and said rear manual painting zone are disposed adjacent each other.

3. The apparatus of claim 2, wherein the air exhaust means includes means for circulating a part of the air exhausted from said first and second painting zones to said automatic painting zone.

4. The apparatus of claim 2, wherein said air supply means includes a single air conditioner for conditioning air to flow in said duct means to both said front manual painting zone and said rear manual painting zone, and including another air conditioner disposed in said exhaust means for said automatic painting zone.

5. The apparatus of claim 1, wherein said air conditioning means is disposed on said booth overlaying the first and second legs of the path.

6. The apparatus of claim 1, wherein said intermediate zone includes a flash-off zone disposed in the bight portion of the path of said painting room.

7. The apparatus of claim 6, further comprising exhaust air circulating means re-circulating the air exhausted from said flash-off zone into said flash-off zone of the painting room, means providing direct communication between said front and said rear painting zone beyond and separate from said flash-off zone.

8. The apparatus of claim 7, wherein said exhaust air circulating means includes a solvent adsorber and a heater for treating the air from the flash-off zone.

9. The apparatus of claim 1, wherein said air exhaust means further includes a solvent adsorber and a total heat exchanger disposed upstream of said solvent adsorber in the direction of air flow, for recovering sensible heat and latent heat of the air exhausted from said painting room prior to entering the adsorber.

10. The apparatus of claim 9, wherein said air exhaust means includes means for circulating a part of the air exhausted from front and rear painting zones to said intermediate zone, and means for conducting the remainder of said exhausted air outside of said painting room upstream of said solvent adsorber and said total heat exchanger.

11. The apparatus of claim 1, wherein said room includes a dusting zone in the first leg of the path upstream of said front painting zone in the direction of travel of the objects.

12. The apparatus of claim 1, wherein the objects being painted are car bodies, and further comprises a conveyor disposed in said booth positioned to convey objects being painted from said front painting zone to and including the rear painting zone.

* * * * *